US006435191B1

(12) United States Patent
Roudabush et al.

(10) Patent No.: US 6,435,191 B1
(45) Date of Patent: Aug. 20, 2002

(54) TOBACCO SEPARATOR

(75) Inventors: Mark Roudabush; Jack Morrison, both of Richmond, VA (US)

(73) Assignee: DIMON Inc., Danville, VA (US)

( * ) Notice: Subject to any disclaimer, the term of this patent is extended or adjusted under 35 U.S.C. 154(b) by 0 days.

(21) Appl. No.: 09/335,898

(22) Filed: Jun. 18, 1999

Related U.S. Application Data

(60) Provisional application No. 60/122,100, filed on Feb. 26, 1999.

(51) Int. Cl.[7] ..... A24B 7/14; B07C 5/00

(52) U.S. Cl. ..... 131/110; 131/108; 209/638; 209/639; 209/644; 209/645

(58) Field of Search ..... 131/370, 313, 131/318, 110, 108, 109.2; 209/638, 639, 644, 645

(56) References Cited

U.S. PATENT DOCUMENTS

| | | | |
|---|---|---|---|
| 518,082 | A | 4/1894 | Stuckey et al. |
| 974,395 | A | 11/1910 | Kidder |
| 1,530,277 | A | 3/1925 | Mettler, Sr. |
| 1,863,666 | A | 6/1932 | Lorentz |
| 1,903,931 | A | 4/1933 | Molins et al. |
| 1,962,668 | A | 6/1934 | Olney |
| 2,130,880 | A | 9/1938 | Durning |
| 2,173,088 | A | 9/1939 | Eissmann |
| 2,275,849 | A | 3/1942 | Fraser |
| 2,658,617 | A | 11/1953 | Rowell |
| 2,667,174 | A | 1/1954 | Eissmann |
| 2,697,439 | A | 12/1954 | Davis |
| 2,825,457 | A | 3/1958 | Rowell |
| 2,852,137 | A | 9/1958 | Hagopian |
| 2,941,667 | A | 6/1960 | Hilgartner, Jr. et al. |
| 2,944,629 | A | 7/1960 | Eissmann |
| 2,988,213 | A | 6/1961 | Davis et al. |
| 3,010,576 | A | 11/1961 | Harte et al. |
| 3,034,646 | A | 5/1962 | Eissmann et al. |
| 3,074,413 | A | 1/1963 | McArthur |
| 3,092,117 | A | 6/1963 | Lebbe |
| 3,164,548 | A | 1/1965 | Rowell et al. |
| 3,200,947 | A | 8/1965 | Wochnowski |
| 3,240,335 | A | 3/1966 | Vandenhoeck |
| 3,265,209 | A | 8/1966 | Wochnowski et al. |
| 3,308,950 | A | 3/1967 | Harte et al. |
| 3,360,125 | A | 12/1967 | Horsey |
| 3,362,414 | A | 1/1968 | Wochnowski |
| 3,378,140 | A | 4/1968 | Wochnowski et al. |
| 3,397,782 | A | 8/1968 | Kwong et al. |
| 3,443,688 | A | 5/1969 | Molins |

(List continued on next page.)

FOREIGN PATENT DOCUMENTS

| | | |
|---|---|---|
| DE | 630756 | 6/1936 |
| FR | 828904 | 6/1938 |
| GB | 746106 | 3/1956 |
| GB | 755252 | 8/1956 |
| GB | 1167866 | 10/1969 |
| GB | 2231770 | 11/1990 |
| WO | WO 9014020 | 11/1990 |

*Primary Examiner*—James Derrington
*Assistant Examiner*—Dianne A. Walls
(74) *Attorney, Agent, or Firm*—Hunton & Williams

(57) ABSTRACT

Apparatus for separating particles contained in threshed leaf tobacco includes a plurality of separating chambers, each including a separation chamber and having a fan system for establishing a generally upward air flow. A covered, high speed conveyor of projects the tobacco across the upward flow of air in each chamber in conjunction with additional make up air from the covered, high speed conveyor. Lighter particles of tobacco are carried upward and exit the chamber via a separating mechanism. Heavier particles of tobacco fall onto an integral conveyor and are discharged from the chamber onto another covered, high speed conveyor connecting it to the next chamber. The separating chambers are mounted in line in a configuration to suit the tobacco being processed.

26 Claims, 3 Drawing Sheets

U.S. PATENT DOCUMENTS

| | | | | | |
|---|---|---|---|---|---|
| 3,542,037 | A | | 11/1970 | Pietralunga | |
| 3,593,851 | A | | 7/1971 | Davidson | |
| 3,608,716 | A | | 9/1971 | Rowell et al. | |
| 3,655,043 | A | | 4/1972 | Wochnowski et al. | |
| 3,727,755 | A | | 4/1973 | Cristiani | |
| 3,986,949 | A | | 10/1976 | Di Duca et al. | |
| 4,003,385 | A | | 1/1977 | Adebahr et al. | |
| 4,045,334 | A | | 8/1977 | Ferray et al. | |
| 4,213,852 | A | | 7/1980 | Etkin | |
| 4,253,940 | A | | 3/1981 | Price | |
| 4,405,451 | A | | 9/1983 | Roman | |
| 4,411,038 | A | | 10/1983 | Mukai | |
| 4,465,194 | A | | 8/1984 | Coleman | |
| 4,475,562 | A | | 10/1984 | Thatcher et al. | |
| 4,618,415 | A | | 10/1986 | Vecchio et al. | |
| 4,701,256 | A | | 10/1987 | Cross, Jr. | |
| 4,755,284 | A | | 7/1988 | Brooks et al. | |
| 4,915,824 | A | | 4/1990 | Surtees | |
| 4,932,423 | A | | 6/1990 | Lauenstein et al. | |
| 5,099,863 | A | | 3/1992 | Coleman | |
| 5,205,415 | A | | 4/1993 | Surtees | |
| 5,325,875 | A | | 7/1994 | Coleman et al. | |
| 5,394,893 | A | | 3/1995 | Coleman et al. | |
| 5,460,189 | A | | 10/1995 | Coleman et al. | |
| 5,476,109 | A | | 12/1995 | Coleman et al. | |
| 5,538,017 | A | * | 7/1996 | Webb et al. | 131/110 |
| 5,967,146 | A | * | 10/1999 | Orihara et al. | 131/84.3 |

* cited by examiner

TOBACCO SEPARATOR

This application claims the benefit of U.S. Provisional Application No. 60/122,100, filed Feb. 26, 1999.

BACKGROUND OF THE INVENTION

1. Field of the Invention

The invention relates to an apparatus for separating threshed leaf tobacco with minimum degradation and in particular avoiding the use of rotary airlocks and rotary infeed projecting devices.

2. Description of Background Art

Tobacco in the form of threshed leaves comprises lamina, lamina with attached stem, stem and stem with attached lamina. It is necessary to separate the lighter tobacco particles from this mixture. Normally, conveyors and fans are used to assist in this separation operation.

Hithertofore, apparatus for separating lighter particles from tobacco particles contained in threshed leaf tobacco included separator units each including a separation chamber having a fan system for establishing a generally upward air flow within the separation chamber. A tobacco particle projector is required to project tobacco particles across the air flow in the chamber so that lighter particles are carried upwardly by the air flow within the chamber. An endless foraminous conveyor is provided within the separation chamber that extends upwardly from the projecting side of the chamber to the receiving side thereof Currently available separating apparatus requiring a particle projector, or inlet winnower, and an inclined foraminous conveyor have some deficiencies. More specifically, the heavier tobacco particles have a tendency to gravitate to the lowest point in the separation chamber. In view of the fact that the lowest point corresponds to the area adjacent to the location of the particle projecting mechanism, efficient operation of the separator apparatus does not occur.

Buildup of tobacco particles in an area adjacent to the location of the particle projecting mechanism not only tends to form a blockage but also tends to damage the threshed leaf tobacco. In addition, there is a tendency that heavier particles discharging from the apparatus contain lighter particles clumped together. Thus, it is required to provide an additional handling unit to facilitate the separation of these particles.

SUMMARY OF THE INVENTION

According to the present invention, threshed tobacco leaves are separated by using a covered, high speed conveyor that is inclined to deliver tobacco particles into a separator chamber. The covered, high speed conveyor is angled to achieve the correct trajectory of product into the chamber to ensure separation of the lighter tobacco product from the heavier tobacco product.

An upward air stream within the chamber separates the lighter material and conveys it pneumatically to a separating unit to enable the product to be discharged from the air stream. The air is recirculated back to the chamber and enters the chamber through a lower plenum chamber.

Heavier particles of tobacco fall onto an integral perforated conveyor that carries the product to the next covered, high speed conveyor for feeding the next separating chamber. The perforated conveyor is disposed to be substantially horizontal or declined as the conveyor extends across the separating chamber.

Further scope of the applicability of the present invention will become apparent from the detailed description given hereinafter. However, it should be understood that the detailed description and specific examples, while indicating preferred embodiments of the invention, are given by way of illustration only, since various changes and modification within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention and wherein.

DETAILED DESCRIPTION OF THE PREFERRED EMBODIMENTS

Figure 1:
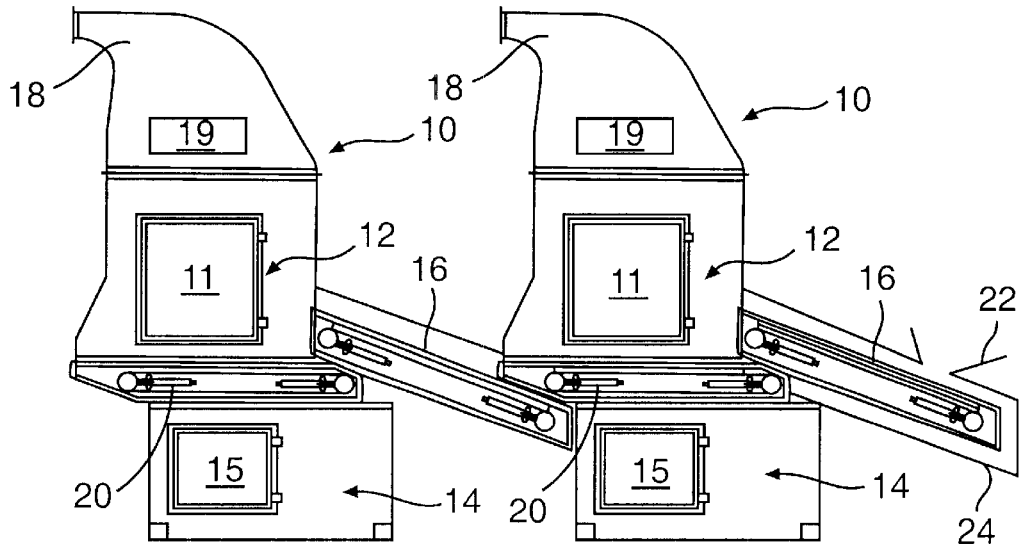
FIG. 1 is an elevational view illustrating two separation apparatus arranged in series with each other.
Figure 2:
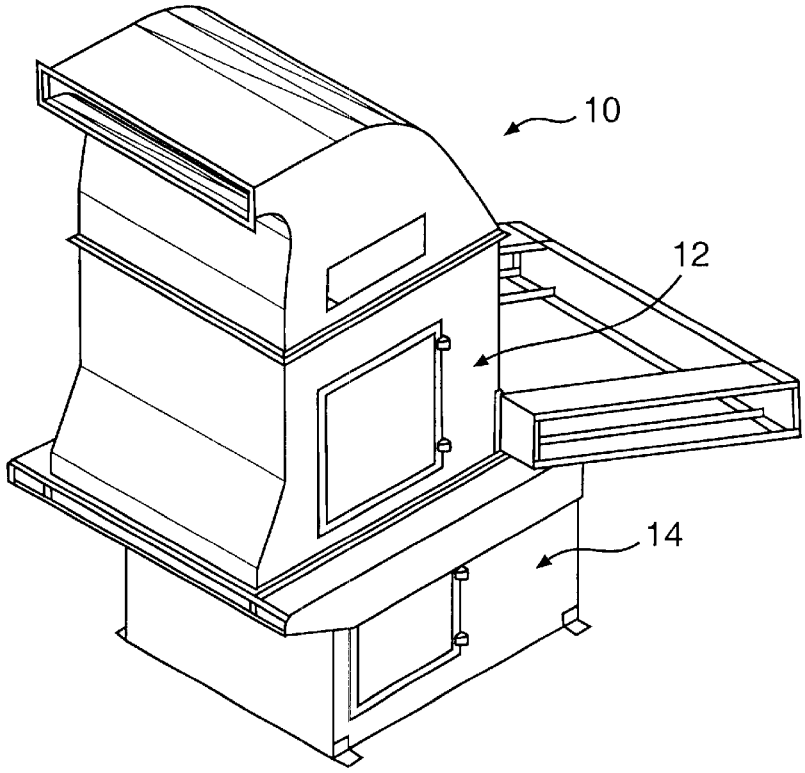
FIG. 2 is a perspective view illustrating one of the separation apparatus of FIG. 1.

As illustrated in FIGS. 1 and 2, a separation apparatus 10 is provided for separating particles contained in threshed leaf tobacco. The separation apparatus 10 includes a plurality of separation chambers 12. The separation chamber 12 includes a door 11 for gaining access to the separation chamber. The door 11 is constructed to be air tight to maintain the air pressure within the separation chamber 12. Each separation chamber 12 includes a lower plenum chamber 14 for positioning a fan for establishing a generally upward air flow within the separation chamber 12.

Threshed leaf tobacco is deposited in the hopper 22 and falls onto a covered, high speed conveyor 16 that can be ribbed, smooth or otherwise profiled for projecting the tobacco across the upward flow of air in each separation chamber 12 in conjunction with additional make up air from the covered, high speed conveyor 16. The high speed conveyor 16 is covered with a housing 24 for maintaining the air pressure within the separation chamber 12. Lighter particles of tobacco are carried upwardly and exit at conduit 18 of the separation chamber 12 via a separating mechanism. The conduit 18 includes a light 19 for illuminating the conduit 18. The light 19 is constructed to be air tight to maintain the air pressure with the conduit 18. Heavier particles of tobacco fall onto an integral conveyor 20 and are discharged from the separation chamber 12 onto another high speed conveyor 16 connecting it to the next separation chamber 12. The separation apparatus 12 are mounted in line in a configuration to suit the tobacco being processed. Multiple separation apparatus 12 can be operatively positioned relative to each other to permit the desired separation of the tobacco.

The separation apparatus 12 are arranged on the same plane with the upwardly projecting covered, high speed conveyor 16 providing the means for elevating the tobacco particles, that have not yet separated, as the tobacco particles travel from one separation apparatus to another.

The lower plenum chamber 14 includes a door 15 for gaining access to the plenum chamber 14. The door 15 is formed in an air tight manner to maintain the air pressure within the separation apparatus 12.

The discharge conveyor 20 extends substantially horizontally or is declined across the separating chamber of the separation apparatus 12 for supplying heavier particles of tobacco from the separating chamber onto an adjacent supply conveyor or covered, high speed conveyor 16 operatively connected to an adjacent separating chamber. The discharge conveyor 20 is formed of a foraminous material to permit a supply of air to flow therethrough.

Figure 3:
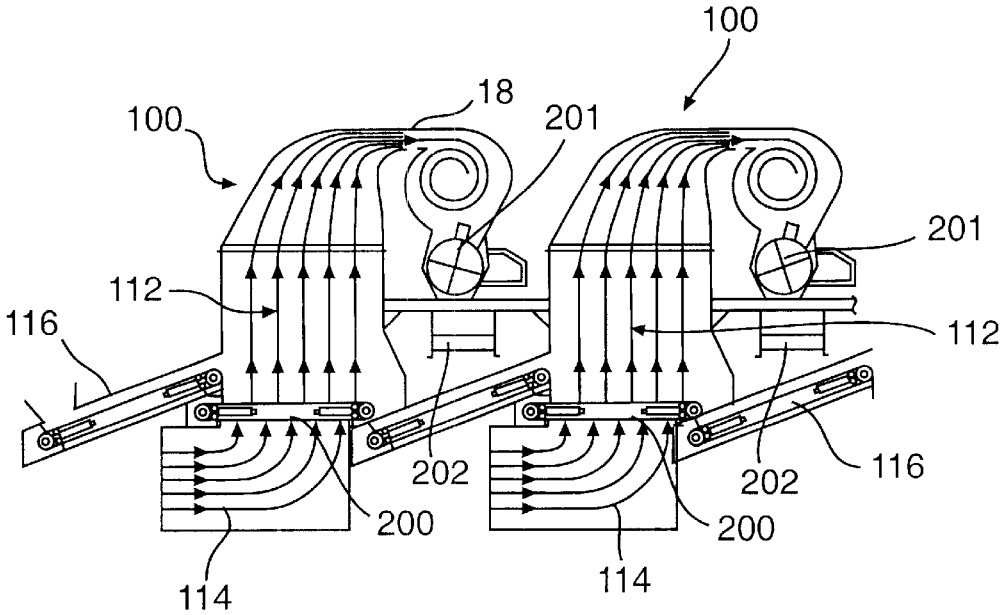
FIG. 3 is a cross-sectional view illustrating the flow of air through the separation chamber of the separation apparatus.
Figure 4:
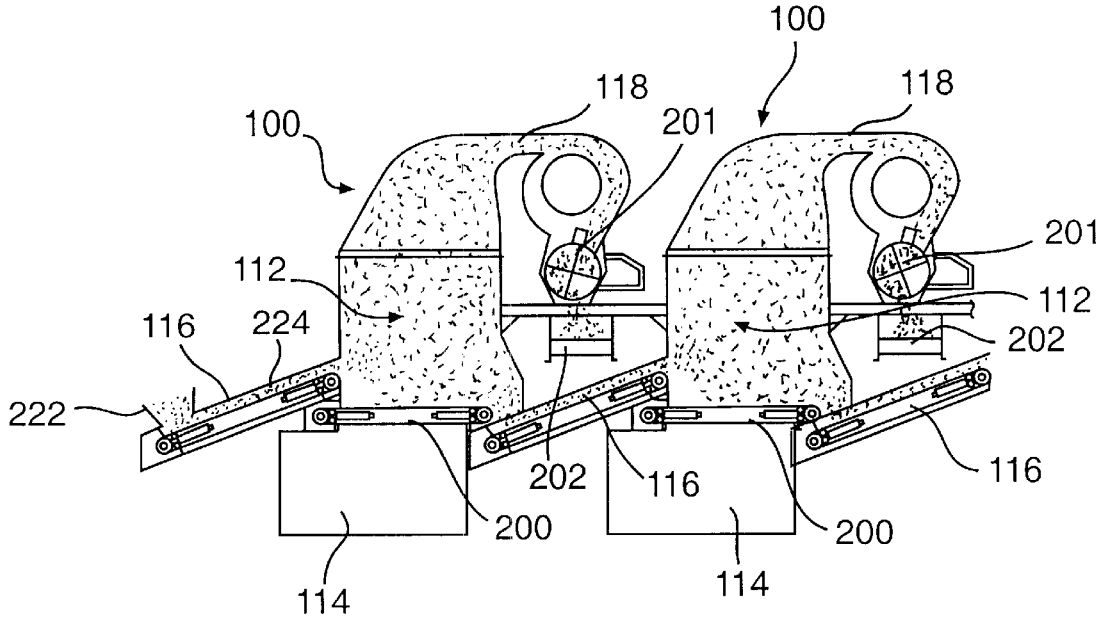
FIG. 4 is a cross-sectional view illustrating the flow of air and tobacco products through the separation chamber of the separation apparatus.
Figure 5:
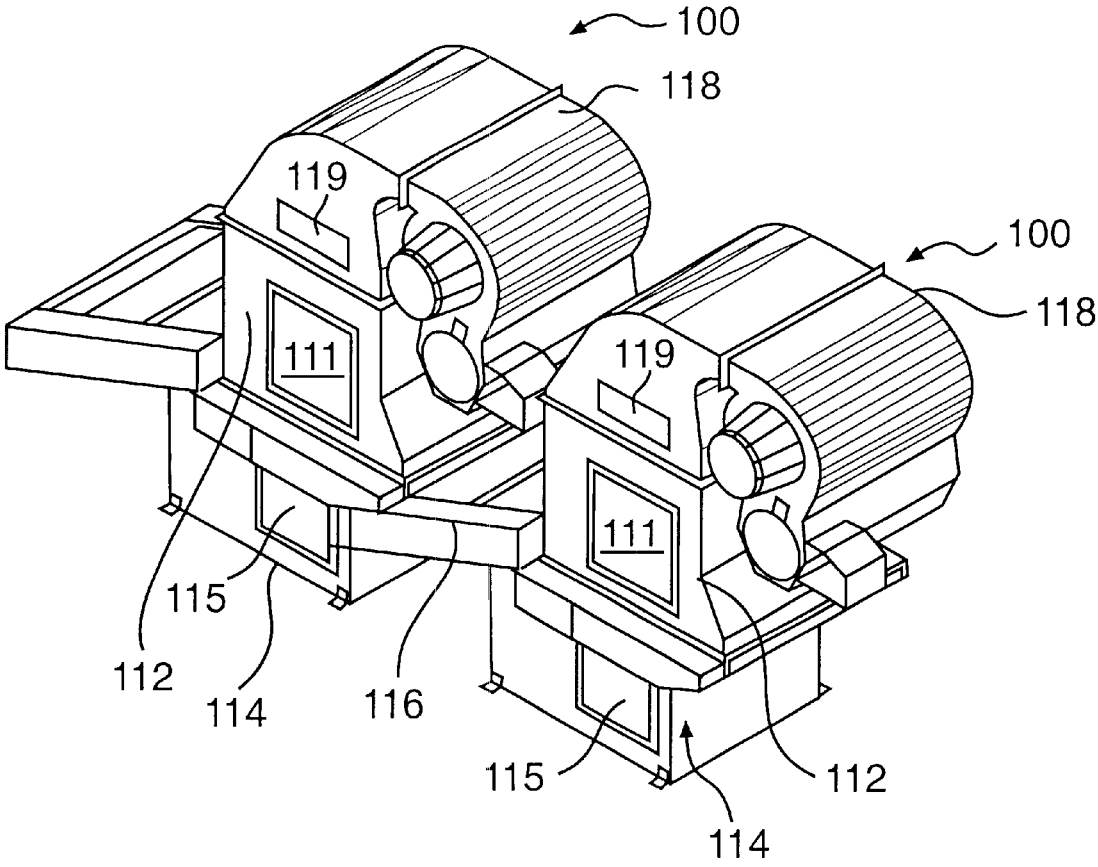
FIG. 5 is a perspective view illustrating the separation apparatus illustrated in FIGS. 2 and 3.

As illustrated in FIGS. 3–5, a separation apparatus 100 is provided for separating particles contained in threshed leaf tobacco. The separation apparatus 100 includes a plurality of separation chambers 112. The separation chamber 112 includes a door 111 for gaining access to the separation chamber. The door 111 is constructed to be air tight to maintain the air pressure within the separation chamber 112.

Each separation chamber 112 includes a plenum chamber 114 for establishing a generally upward air flow within the separation chamber 112. The plenum chamber 114 includes a door 115 for gaining access to the plenum chamber. The door 115 is constructed to be air tight to maintain the air pressure within the plenum chamber 114. A covered, high speed conveyor 116 projects the tobacco into the separation chamber 112 and into the upward flow of air in each separation chamber 112 in conjunction with additional make up air from the covered, infeed conveyor 116. Lighter particles of tobacco are carried upwardly and exit at conduit 118 of the separation chamber 112 via a separating mechanism. The conduit 118 includes a light 119 for illuminating the conduit 118. The light 119 is constructed to be air tight to maintain the air pressure within the conduit 118.

Heavier particles of tobacco fall onto an integral conveyor 200 and are discharged from the separation chamber 112 onto another high speed conveyor 116 connecting it to the next separation chamber 112. The separation apparatus 112 are mounted in line in a configuration to suit the tobacco being processed.

Multiple separation apparatus 112 can be operatively positioned relative to each other to permit the desired separation of the tobacco. The separation apparatus 112 are arranged on the same plane with the upwardly projecting covered high speed conveyor 116 providing the means for elevating the tobacco as particles that are not yet separated travel from one separation apparatus to another.

As illustrated in FIGS. 3 and 4, the exit conduit 118 is connected to a valving mechanism 201 that deposits the separated tobacco product onto the discharge belt 202.

In operation, threshed leaves of tobacco containing lamina, lamina with attached stem, stem and stem with attached lamina are supplied to a hopper 222 and fall onto the covered, high speed conveyor 116 for supplying the threshed tobacco to the separation chamber 112. The high speed conveyor 116 discharges the threshed tobacco so as to project the particles into the central portion of the separation chamber 112. An air supply from the lower plenum chamber 114 mixes with the threshed tobacco to separate the lighter particles to supply the lighter particles upwardly into the conduit 118. The lighter particles of the threshed tobacco are thereafter positioned into a sealed valving mechanism 201 that provides an air tight exit of the separated threshed tobacco to a discharge conveyor 202.

Heavier threshed tobacco particles fall onto the integral conveyor 200 for supplying the heavier threshed tobacco to a covered, high speed conveyor 116 connected to the adjacent separation chamber 112. Thereafter, the same separation process occurs with the lighter particles being supplied to the conduit 118 and the heavier particles being supplied to a covered, high speed conveyor 116 of the next separation chamber 112.

The separation chambers 112 are mounted at the same elevation. It is not necessary to change the elevation of the separation chambers 112 as the threshed tobacco is supplied from one separation chamber 112 to an adjacent separation chamber 112. The covered, high speed conveyors 116 provide the necessary elevation of the threshed tobacco to project the particles into the next separation chamber 112. In addition, the connection of the separation chambers 112 and the covered, high speed conveyors 116 are air tight to permit the pressurization of the system to permit the separation of the threshed tobacco product.

The invention thus being described, it will be obvious that the same may be varied in many ways. Such variations are not to be regarded as a departure from the spirit and scope of the invention, and all such modification as would be obvious to one skilled in the art are intended to be included within the scope of the following claims.

What is claimed is:

1. A separation apparatus for separating particles contained in threshed leaf tobacco comprising:

at least two sequential separating chambers spaced apart and mounted at the same elevation;

an air flow in communication with said separating chambers for establishing a generally upward air flow within each separating chamber;

a covered high speed supply conveyor belt positioned between and substantially outside the separating chambers and arranged at a predetermined upward angle relative to said separating chambers for projecting tobacco into the separating chamber and into the upward flow of air in the separating chambers;

a discharge conduit for discharging lighter particles of tobacco carried upwardly by said upward flow of air to exit from the separating chamber; and respective discharge conveyor belts associated with each separating chamber for conveying the heavier particles of tobacco from the separating chamber onto an adjacent high speed supply conveyor belt which in turn is operatively connected to an adjacent separating chamber, said discharge conveyor belt extending substantially horizontally or declined across the separating chamber.

2. The separation apparatus for separating particles contained in threshed leaf tobacco according to claim 1, wherein said high speed supply conveyor belt supplies tobacco into a central portion of the separating chamber.

3. The separation apparatus for separating particles contained in threshed leaf tobacco according to claim 1, wherein the discharge conveyor belt is a foraminous conveyor.

4. The separation apparatus for separating particles contained in threshed leaf tobacco according to claim 1, wherein said discharge conduit includes a valving mechanism for enabling discharge of separated tobacco from the separation apparatus.

5. The separation apparatus for separating particles contained in threshed leaf tobacco according to claim 1, wherein the high speed supply conveyor belt is a ribbed conveyor for facilitating the supply of tobacco product to the separating chamber.

6. The separation apparatus for separating particles contained in threshed leaf tobacco according to claim 1, wherein the separating chamber, the high speed supply conveyor belt, the discharge conveyor belt and the discharge conduit substantially are air tight.

7. The separation apparatus for separating particles contained in threshed leaf tobacco according to claim 1, and further including a separated tobacco discharge belt for removing separated particles supplied from the discharge conduit.

8. The separation apparatus for separating particles contained in threshed leaf tobacco according to claim 1, wherein a plurality of separating chambers are arranged in an in line arrangement with the discharge conveyor belt of a prior separating chamber supplying threshed leaf tobacco to the high speed supply conveyor belt of a subsequent separating chamber.

9. A separation apparatus for separating particles contained in threshed leaf tobacco comprising one or more separating chambers; each of the separating chambers comprising:

a means for establishing a generally upward air flow within the separating chamber;

a covered high speed supply conveyor belt located substantially outside the separating chamber and arranged at a predetermined upward angle relative to the separating chamber for conveying tobacco to the separating chamber and projecting tobacco into the path of the air flow;

a discharge conduit for discharging lighter tobacco particles carried upwardly through the separating chamber by the air flow out of the separating chamber;

a discharge conveyor belt extending substantially horizontally or declined across the separating chamber for conveying heavier tobacco particles out of the separating chamber;

wherein the one or more separating chambers are configured such that a plurality of separating chambers are arranged sequentially, at the same elevation and spaced apart such that substantially all of the heavier tobacco particles discharged by a respective discharge conveyor belt of an upstream separating chamber are discharged onto a respective high speed supply conveyor belt of a downstream separating chamber.

10. The separation apparatus according to claim 9, wherein each respective high speed supply conveyor belt supplies tobacco into a central portion each respective separating chamber.

11. The separation apparatus according to claim 9, wherein the separation apparatus is substantially air tight.

12. The separation apparatus according to claim 9, wherein each of the discharge conveyor belts is an endless foraminous conveyor.

13. The separation apparatus according to claim 9, wherein each of the high speed supply conveyor belts is ribbed for facilitating the supply of tobacco to its respective separating chamber.

14. The separation apparatus according to claim 9, wherein each of the separating chambers further comprises a valve mechanism and a separated tobacco discharge belt for removing lighter tobacco particles discharged out of the separating chamber through its respective discharge conduit.

15. The separation apparatus according to claim 9, wherein each of the means for establishing a generally upwards air flow comprises a lower plenum chamber beneath a respective discharge conveyor belt; the air flow beneath the respective discharge conveyor belt moving within the lower plenum chamber in a direction generally parallel with the respective discharge conveyor belt.

16. The separation apparatus according to claim 9, wherein at least a portion of the lower plenum chamber is located beneath a respective high speed supply conveyor belt.

17. The separation apparatus according to claim 9, comprising a plurality of separating chambers arranged sequentially, at substantially the same level with one another, and spaced apart such that substantially all of the heavier tobacco particles discharged by a respective discharge conveyor belt of an upstream separating chamber are discharged onto a respective high speed supply conveyor belt of a downstream separating chamber.

18. A seperation apparatus for seperating particles contained in threshold leaf tobacco comprising one or more separating chambers; each of the separating chambers comprising:

a means for establishing a generally upward air flow within the separating chamber;

a covered high-speed supply conveyor belt located substantially outside the separating chamber and arranged at a predetermined upward angle relative to the separating chamber for conveying tobacco into the path of the air flow;

a discharge conduit for discharging lighter tobacco particles carried upwardly through the separating chamber by the air flow out of the separating chamber;

a discharge conveyor belt extending substantially horizontally or declined across the separating chamber for conveying heavier tobacco particles out of the separating chamber;

wherein the one or more separating chambers are configured such that a plurality of separating chambers are arranged sequentially, at the same elevation, and spaced apart such that all of the heavier tobacco particles discharged by a respective discharge conveyor belt of an upstream separating chamber are discharged onto a respective high speed supply conveyor belt of a downstream separating chamber.

19. The separation apparatus according to claim 18, wherein each respective high speed supply conveyor belt supplies tobacco into a central portion each respective separating chamber.

20. The separation apparatus according to claim 18, wherein the separation apparatus is substantially air tight.

21. The separation apparatus according to claim 18, wherein each of the discharge conveyor belts is an endless foraminous conveyor.

22. The separation apparatus according to claim 18, wherein each of the high speed supply conveyor belts is ribbed for facilitating the supply of tobacco to its respective separating chamber.

23. The separation apparatus according to claim 18, wherein each of the separating chambers further comprises a valve mechanism and a separated tobacco discharge belt for removing lighter tobacco particles discharged out of the separating chamber through its respective discharge conduit.

24. The separation apparatus according to claim 18, wherein each of the means for establishing a generally upwards air flow comprises a lower plenum chamber beneath a respective discharge conveyor belt; the air flow beneath the respective discharge conveyor belt moving within the lower plenum chamber in a direction generally parallel with the respective discharge conveyor belt.

25. The separation apparatus according to claim 24 wherein at least a portion of the lower plenum chamber is located beneath a respective high speed supply conveyor belt.

26. The separation apparatus according to claim 18, comprising a plurality of separating chambers arranged sequentially, at substantially the same level with one another, and spaced apart such that all of the heavier tobacco particles discharged by a respective discharge conveyor belt of an upstream separating chamber are discharged onto a respective high speed supply conveyor belt of a downstream separating chamber.

* * * * *